US006565284B2

(12) United States Patent
Gearhart

(10) Patent No.: US 6,565,284 B2
(45) Date of Patent: May 20, 2003

(54) INFILTRATION CONTROL SYSTEM AND METHOD

(76) Inventor: Stephen V. Gearhart, 515 5th St., P.O. Box 398, Hudson, IA (US) 50643

( * ) Notice: Subject to any disclaimer, the term of this patent is extended or adjusted under 35 U.S.C. 154(b) by 0 days.

(21) Appl. No.: 09/733,592

(22) Filed: Dec. 8, 2000

(65) Prior Publication Data

US 2002/0071721 A1 Jun. 13, 2002

(51) Int. Cl.[7] ..... E02B 11/00

(52) U.S. Cl. ..... 405/37; 405/39; 405/51; 405/80; 137/2; 137/12; 137/236.1

(58) Field of Search ..... 405/36, 37, 39, 405/40, 41, 51, 80; 137/1, 236.1, 2, 12

(56) References Cited

U.S. PATENT DOCUMENTS 3,173,269 A 3/1965 Imbertson
3,834,167 A 9/1974 Tabor
3,855,800 A 12/1974 Ganzinotti
4,022,059 A * 5/1977 Schontzler et al. ..... 141/130
4,127,030 A * 11/1978 Martig, Jr. ..... 73/215
4,275,766 A * 6/1981 Aronson ..... 405/80
4,295,197 A 10/1981 Petroff
4,352,591 A 10/1982 Thompson
4,494,345 A * 1/1985 Peterson ..... 137/414
5,063,505 A 11/1991 Pate et al.
5,131,423 A 7/1992 Shaw
RE35,503 E * 5/1997 Hunter ..... 73/861.63
5,684,250 A * 11/1997 Marsh et al. ..... 73/227
6,241,485 B1 * 6/2001 Warwick ..... 417/300
6,318,395 B1 * 11/2001 Anderson et al. ..... 137/236.1

* cited by examiner

*Primary Examiner*—Heather Shackelford
*Assistant Examiner*—Frederick L. Lagman
(74) *Attorney, Agent, or Firm*—James C. Nemmers; Douglas J. Stilwell

(57) ABSTRACT

A system for maintaining a surcharge on a sanitary sewer collection system to minimize the pressure differential across pipe walls carrying the waste and to offset the buoyant effects of hydrostatic pressure on the outside of the pipe. Pinch valves or other remotely controllable pipe closing devices are employed in combination with a system of monitors and a centralized control system to maintain and periodically release fluid from the surcharged system.

10 Claims, 3 Drawing Sheets

INFILTRATION CONTROL SYSTEM AND METHOD

BACKGROUND OF THE INVENTION

In 1972 the Clean Water Act was established which provided funding for the discovery and elimination of infiltration in public sewer systems. In general infiltration is the influx of material into a sewer system from unwanted sources. The problem with infiltration arises primarily when groundwater or material from some other source enters sanitary sewer systems through cracks or leaks or through simple permeation through porous walls. Methods used to address the problem of infiltration were primarily the enlargement of treatment facilities in combination with periodic and haphazard repair of cracks, leaks or other infirmities in the traditional, gravity-driven sewer collection system. The enlargement of treatment facilities and storage facilities has and continues to cost local, state, and federal governments billions of dollars. To date, this type of repair and accommodation of extraneous water infiltration has been inadequate to address the continued problem of infiltration. In particular, the building, operation, and maintenance of larger treatment facilities to accommodate greater volumes of infiltration is a cost prohibitive or ineffective use of valuable resources. Further, the expansion of collection systems and enlargement of treatment facilities, both of which comprise enhancements to system capacity, increase the ability of the system to drain a region and, in fact, allow greater amounts of infiltration. Therefore, the solution provided to date has, in fact related to the increased drainage of treatment systems, increased treatment, and an increased volume of infiltration. Finally, if the haphazard repair of sewer systems is practiced, a great deal of time and labor is consumed to monitor, track and discover the location of infiltration of migrating groundwater in different portions of a gravity driven sanitary sewer system.

To compound the problems that existed prior to 1972, the sanitary sewer systems continue to age. Over time, cracks and fissures develop in sewer lines as the ambient groundwater conditions surrounding the sewers vary and sections of sewer are subjected to varying buoyant forces. These buoyant forces typically act to push the sewers upward. Depending on the status of surrounding soil, rock, sand, or other support media, the sewer may or may not be adequately secured to resist these buoyant forces. As years pass and sewers age, the process of repeated infiltration through cracks, fissures, or porous pipes causes flowing water to disturb the pipe-surrounding bed or media. This disturbance may further destabilize the pipe bedding and enhance or accelerate pipe movement due to buoyant forces, thus enhancing deterioration, cracking, and the concomitant increased volume of water entering the system through infiltration.

In general, the problems of infiltration referred to above may be attributed to two causes. The first cause, of course, as referenced above, is the presence of cracks, fractures, leaks, or other infirmities with the aging sewer systems. These systems, which typically are gravity driven, often are partially filled with water and/or a mixture of solids and waste liquid. Typically the system has a head space that is filled with air (or with a mixture of air and gases generated through the anaerobic decomposition of the waste being carried in the pipes). The second factor which leads to the problem of infiltration is the pressure differential between the interior of the sanitary sewer collection system piping and the groundwater which exists on the exterior of the pipe in the pore spaces of the surrounding soil and pipe bedding material. This differential drives the infiltration of groundwater. The pressure in the pipes typically is at a level approximately equal to atmospheric pressure. By contrast, the pressure of the pore water in the soil or bedding surrounding the pipe is often many pounds per square foot (also expressed in psi, pounds per square inch, or referred to as "head" and measured in feet of water). For example, if a sanitary sewer pipe were buried eight feet below ground, and the soil surrounding and lying above the pipe were completely saturated with water all the way to the surface of the ground (as may occur in isolated locations or more widely depending on geographic region or timing relative to rainfall events), the pressure at the 8' level on the exterior of the sanitary sewer collection pipe would be 8' of head or approximately 3.5 lbs. per square inch above atmospheric pressure. Such a pressure differential across the conduit wall, when combined with the presence of cracks in the sanitary sewer collection system, leads to infiltration—the driving of ground water into the collection system through the wall or the cracks.

Therefore, there has been and remains a need to minimize or prevent the infiltration of ground water into sanitary sewer collection systems and the exorbitant cost of storage and treatment of all the extraneous water entering the system. In particular, there is a need for a sewer surcharge system wherein liquid (typically water and dilute waste) may be retained in the sewer collection system on a controlled basis to increase the weight of the collection system and minimize the impact of upward hydrostatic forces which attempt to lift or float the system. Further, the maintenance of a dilute wastewater or fluid within the collection system is needed to minimize the pressure differential across the sewer pipe wall and decrease the tendency for groundwater to infiltrate or flow into the pipe system.

SUMMARY OF THE INVENTION

The present invention provides for the surcharging or backing up of a gravity pipe system to a level that will protect the lowest entry ports, such as basements or low lying residences serviced by the gravity sewer system, and which will retain a beneficial level of surcharge material within the system to enhance the weight of the system and minimize infiltration. The surcharging of the pipe lines helps to resist the hydrostatic effect caused by groundwater acting on empty pipe lines wherein the pipe line is subjected to "floatation" due to buoyant forces. The surcharging further serves to at least partially offset the pressure differential across the pipe wall, thus minimizing the driving force for the infiltration and preserving the structural integrity of existing sewer systems.

The surcharged pipelines are controlled by a series of flow-retarding or surcharge maintaining devices such as valves (e.g. pneumatic or hydraulic pinch valves, gate valves, and other valves), sluice gates, dams, weirs or other mechanical or pneumatic means. By allowing the use of flow retarding devices that may be remotely monitored and controlled by a system of computer controlled electronic sensors, a desired degree of automation may be introduced into the system. Preferably, the monitoring system monitors not only pipeline flow, but rainfall and pipeline flow reversal or back-up. Once a rainfall or flow increase is detected, the pinch valve or other flow retarding means may be actuated to close and cause a surcharging of the pipe until such point that the surcharged pipe system is filled all of the way to within a short distance of the bottom of the lowest entry point. Of course, in areas where infiltration present serious problems even in the absence of a rainfall event (and the lengthy period following such an event when water levels recede) the surcharge may be maintained on a more permanent basis as needed and occasionally released to prevent the buildup of organic material and the beginning of anaerobic conditions. For example, gates may be maintained in select locations such as manholes to retain a surcharge and allow flow-over at an elevation just below the lowest critical point.

The surcharge system may be installed throughout an entire collection system or a part of a system with pinch valves or other flow retarding devices and monitoring devices installed as necessary to accommodate elevation differences and protect critical or low areas as needed. Critical areas refer to those areas where surcharged or backed-up water or waste is likely to exit the sewer network into a source (i.e. a basement, a tub, a sink, a toilet, etc.). Critical areas also refer to other areas that may be monitored in order to determine whether an exit is likely or imminent in different location. For example, a given flow level at a selected manhole may provide information sufficient to determine if contamination of source is occurring, likely to occur, or imminent. The throttling effect provided by the pinch valves or other flow retarding means is allowed to continue until such time that peak inflow subsides and a sufficient period of time is allowed to pass following the rainfall event to allow water levels subside to a baseline or dry weather flow level.

The level of automation included in the system may range from a fully manual system to a few selected degrees to a completely automatically functioning system. Additionally, the system of the present invention is preferably designed such that the failure or default position for the system of flow retarding or surcharging devices is an open or wide-open status. In this manner, surcharge liquid is allowed to exit the collection system in the event that one or more of the surcharging devices fail. It is, of course, preferred to provide a manual release for use if system failure results in a valve or gate in a closed position.

DESCRIPTION OF THE PREFERRED EMBODIMENT

Figure 1A:
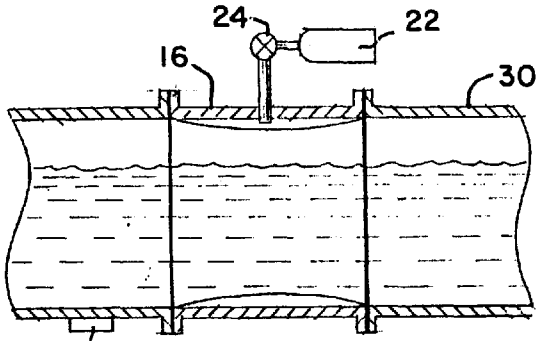
FIG. 1*a* is a cut-away side view of a sewer pipe having a pneumatically controlled pinch valve installed therein with said valve open for full flow.

Sewer systems 2 traditionally comprise a plurality of sources 4 (homes, buildings, etc.) which may themselves include numerous sewage entry points (toilets, tubs, showers, sinks, etc.). From these sources 4, service lines 6 typically extend outwardly and downwardly to municipal lines 8 located under streets, on other public property, or in easements. These municipal lines 8 in turn feed by gravity or through pump means into larger public lines in a network of pipes wherein the pipes typically grow in flow handling capacity up to the primary main lines 10 which carry the sewage to its final destination (typically a treatment facility or flow equalization basin). Periodically throughout the network of pipes manholes 12 exist to allow workers to access the pipes. In general, the networks are gravity driven with periodic pumping stations present in large networks. Of course, the network may exist in any of a number of settings, such as municipal networks, institutional networks, or large private networks. The term municipal is used herein for convenience, but the present invention is not limited in application to municipal systems.

In the present invention, monitors 14 and flow retardant devices 28 are placed at selected locations of a sewer network to detect flow levels and restrict flow at selected locations to retain water or dilute waste in the network 2. As already described, the selective and controlled retention of water or other matter in the system helps to decrease infiltration and decrease pipe deterioration while simultaneously providing information to protect, and protecting low lying or critical points within the system. Sensors as are known to those in the art are installed within the sewer collection system to detect the sewer pipe load and to detect sewage backing up rather than flowing by gravity. Different types of flow meters or sensors may be selected depending on preference, network characteristics, or sensor location characteristics. For example, sensors may be used to detect liquid levels at given locations in the network, or to detect flow rates. For open channels it is common to use flume or weir type metering devices. Such devices may be preferred for use with the current invention in measuring flow through a relatively open area such as a manhole. Other open channel metering devices may include insert-type magnetic or velocity-head devices. For closed conduits, head/pressure, "moving fluid effect", or positive displacement devices may be preferred. Typical head/pressure devices include flow tubes, orifice devices, pitot tubes, rotameters, and venturi meters. "Moving fluid effects" devices include tube-type or insert-type magnetic metering devices, target, vortex shedding, or ultrasonic (doppler or transmission) metering devices. Finally, typical positive displacement devices include propeller and turbine devices. The particular selection of metering devices, of course, depends upon the sizing, the fluid composition (i.e. can the metering device handle solids), the headloss created by the device, the need and ability to repair the device, etc. In light of the foregoing, it will be evident that numerous sensor devices may be appropriate depending on the setting. However, the presently preferred sensor devices are of the ultra-sonic or radar type. The installation of such sensor devices 14 at a plurality of locations throughout the collection system 12 allows for the controlled throttling or flow retarding effect to maintain a surcharge in the collection system while monitoring to protect low-lying or critical areas from back-flow or sewer back-up.

Figure 1B:
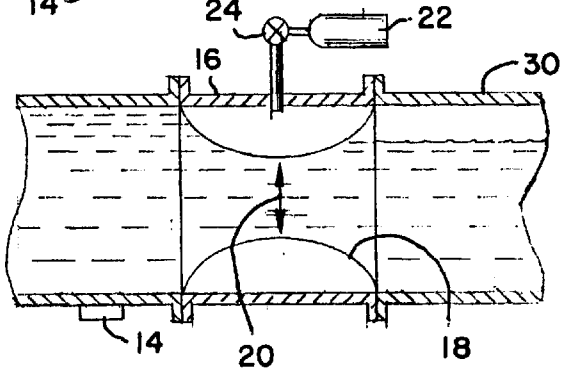
FIG. 1*b* is a cut-away side view of a sewer pipe having a pneumatically controlled pinch valve installed therein with said valve partially closed for restricted flow.

The preferred flow retardant devices 14 described herein are pinch valves 16 (see FIGS. 1*a* and 1*b*), gate valves 34

Figure 2:
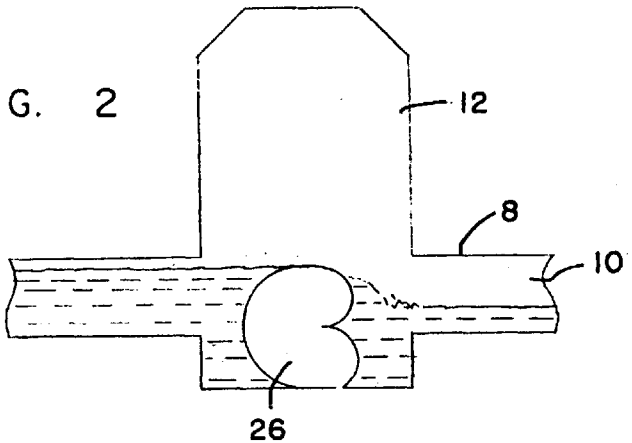
FIG. 2 is a cut-away side view of a manhole having an inflatable weir positioned therein to surcharge a region of sewer pipe adjacent thereto.
Figure 4:
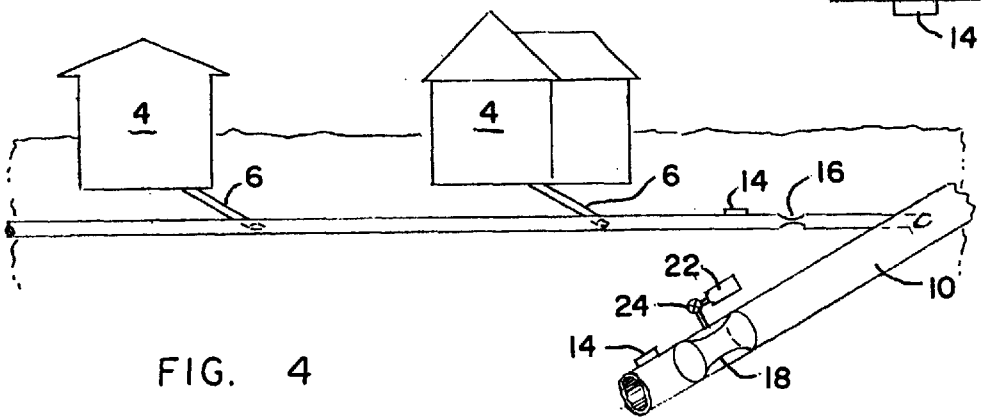
FIG. 4 is a schematic diagram of a sanitary sewer collection system displaying flow level monitors and water retention means within services lines, mains and trunk lines of progressively larger diameter that carry waste from homes serviced by the service lines to a central treatment facility.
Figure 5:
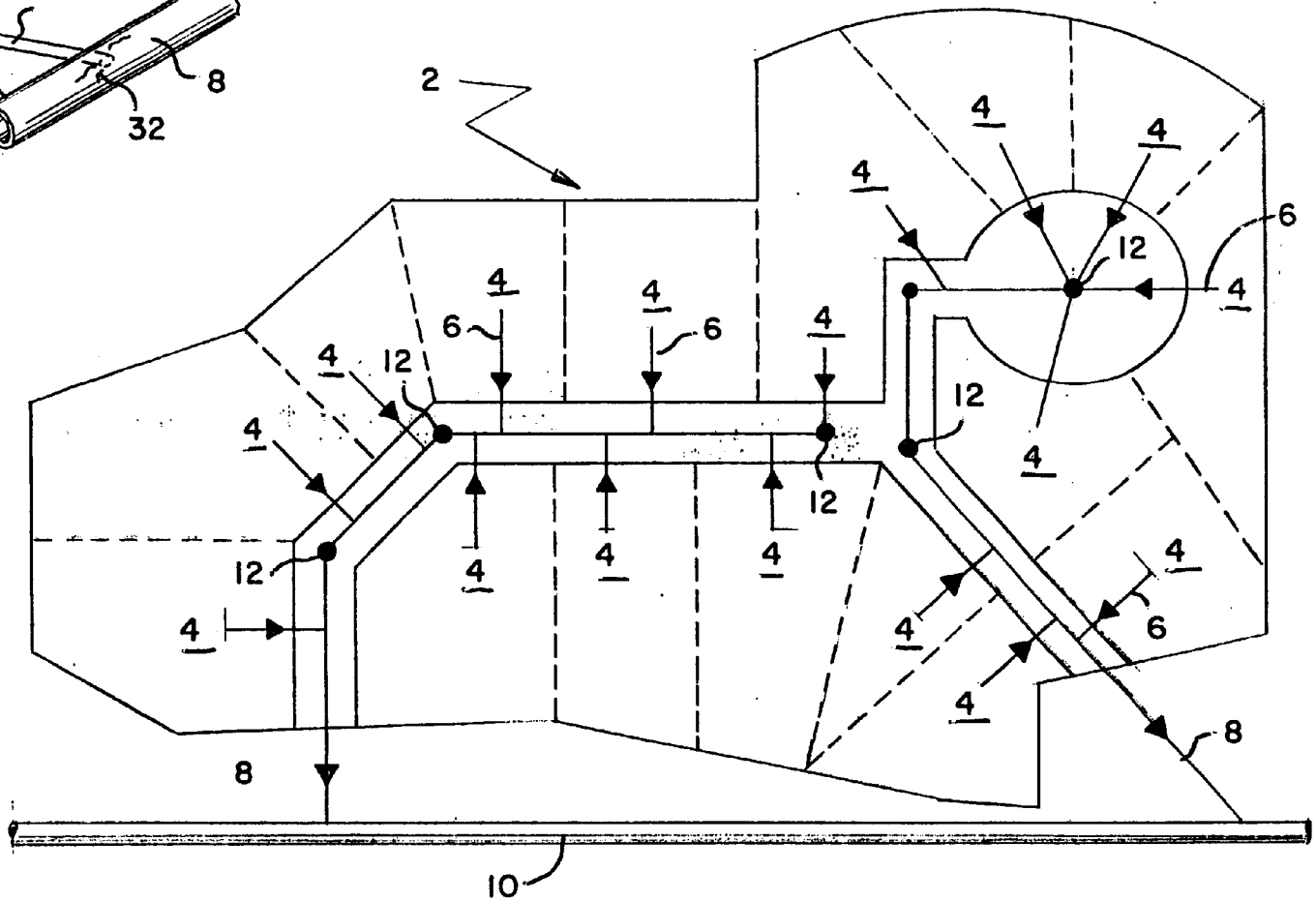
FIG. 5 is a schematic view of a sewer system in relation to a sub-development illustrating service lines, manholes, trunk lines, and main lines.
Figure 3:
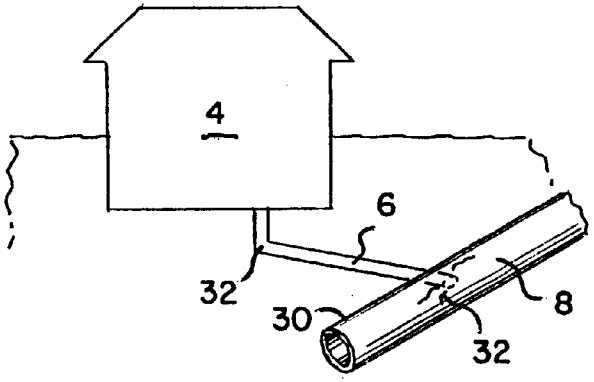
FIG. 3 is a schematic diagram of a sewer collection main in relation to a home serviced by the main and the service line connecting the home to the main.
Figure 6:
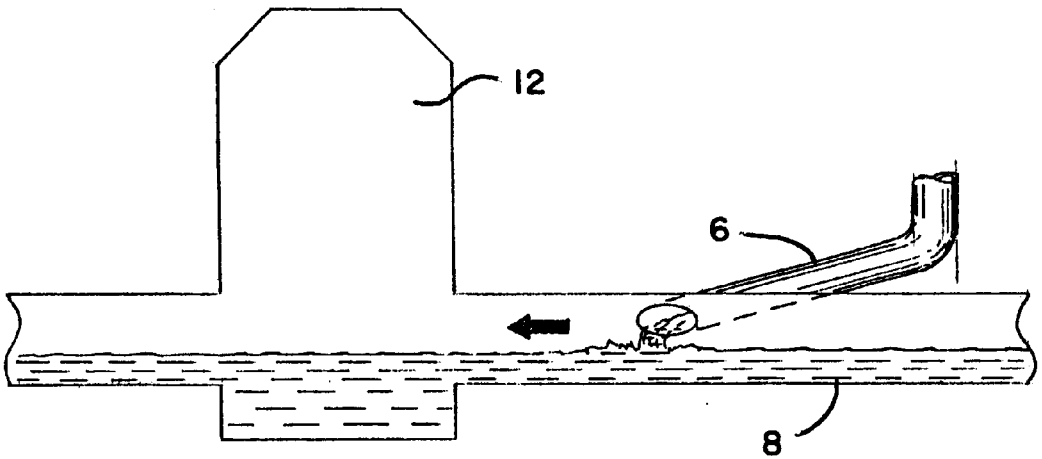
FIG. 6 is a cut-away side view of a manhole illustrating flow without surcharge.
Figure 7:
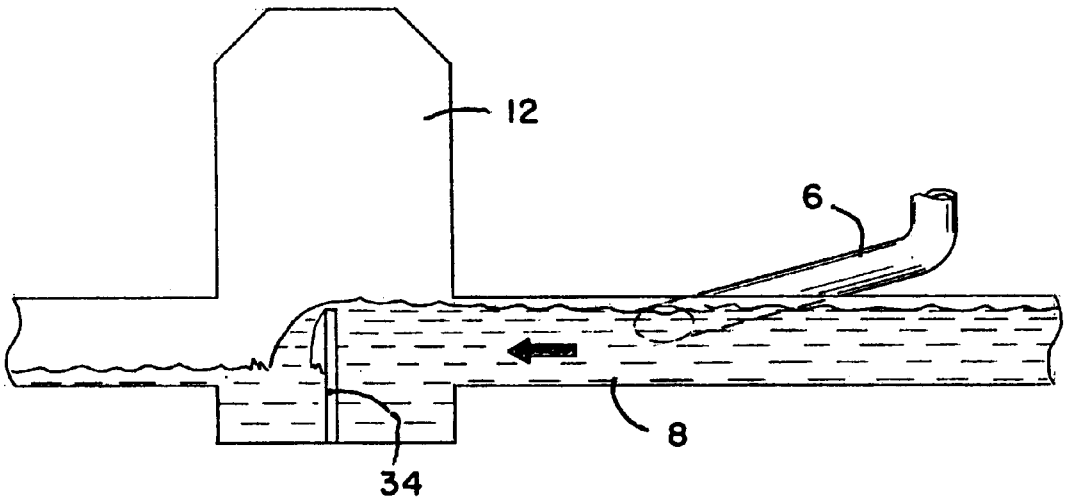
FIG. 7 is a cut-away side view of a manhole illustrating flow over the top of a surcharge gate.

(see FIG. 7) and inflatable weirs 26 (see FIG. 2). Pinch valves 16 are typically placed "in-line" with a section of pipe. These pinch valves 16 present an annular, resilient sleeve 18 that may be inflated to close or constrict the cross sectional area 20 through which flow passes. In general, the partially closed pinch valves 16 allow flow to remain generally laminar. Further, if complete restriction is desired, the pinch valves 16 are able to close around most obstructions (unlike many finely threaded mechanical screw valves or other mechanical valves such as gate valves). Further, the elastic nature of the annular resilient sleeve allows energy from solids that strike the pinch valve to be directed back into the stream rather than entirely absorbed by the valve (as with a mechanical valve that is susceptible to damage from abrasion, etc.). Because of these benefits in addition to the resilient and chemically resistant nature of the pinch valves' elastomeric surface, such valves are particularly well-suited for use in the current invention.

The use of gas-operated pinch valves for various applications is known in the prior art. The Red Valve Company of Pittsburgh, Pa. is well-known manufacturer of such valves. U.S. Pat. No. 5,131,423 describes the use of a system of computer monitored pinch valves to selectively control the flow of potable water through a multistoried building. In particular, the '423 patent describes a system for selectively isolating parts of the potable water system in a building to allow repair or maintenance of portions of the system without completely removing service from the building. Application of pinch valves in sewage pipes has been limited to control of flow in process pipes. Such valves and a monitoring and control system for use in combination with a system of such valves have not been used to maintain a surcharge on a sewage collection system to counteract the buoyant forces of groundwater or the great pressure differential across the collection system walls 30.

The pinch valves 16 of the present invention are controlled by remotely operable pressurized fluid sources 22 which may be actuated to discharge a working fluid (typically a pressurized gas) into the annular resilient sleeve 18 of the pinch valve 16. Typically, very little pressure is required to effectively constrict the flow of water or waste as the pinch valves may effectively restrict the cross sectional area of the pipe if the pressure in the annular sleeve 18 is only slightly greater than the pressure in the pipe. The pinch valves 16 may be remotely controlled through the use of solenoid valves 24 or other valve control means that may be controlled remotely by any of a variety of means including electrical signals, RF signals, or other hard wired or wireless technology. The solenoid valves 24 or other means preferably include a selectively positionable valve mechanism having a depressurized position that is set as the failure or default position. In this manner, the valve will be open and water or dilute waste may be allowed to flow freely away from sources 4 in the event that power to the monitoring and control system is lost.

Other flow retardant means include inflatable weirs, sluice gates, mechanical valves and dams, iris doors or gates and other valve means as are known in the art or which may be developed hereafter. Inflatable weirs 26 are preferred for use in the manholes of "municipal" lines (municipal lines is used herein to refer to any lines that collect flow from more than one source, and include primary trunk lines, and smaller feeder lines). A prior art inflatable weir is disclosed in U.S. Pat. No. 4,352,591 issued Oct. 5, 1982 to Thompson. The '591 patent is a "convoluted" toroidal weir having semi-rigid extensions protruding therefrom. The weir of the '591 patent is combined with a "plastic holder" to secure it in a desired location. The '591 patent specifically discloses this inflatable weir for use in an algae growth reactor. U.S. Pat. No. 3,173,269 (issued Oct. 13, 1961 to Imbertson), U.S. Pat. No. 3,834,167 (issued Sep. 10, 1974 to Tabor), and U.S. Pat. No. 3,855,800 (issued Dec. 24, 1974 to Ganzinotti) all disclose inflatable weirs for use in natural stream or riverbeds, or for use in open-air open channel conduits such as storm ditches, etc. None of these references teach or suggest the use of inflatable weirs to maintain a surcharge in a sewer system or use in combination with a network of sensors to maintain a surcharge in a sewer system.

The inflatable weir 26 flow retardant means of the present invention is preferably located in a manhole. Location of such inflatable weirs in manholes is particularly advantageous for use with the present invention because this placement allows convenient and inexpensive retrofitting of existing sewer systems. In addition, this placement and the generally ample space and easy access associated with the manholes (relative to the rest of the sewer network) allows the use of simple pressurized fluid systems (such as canisters, etc) for inflating the weirs. The inflatable weirs 26 may be of any convenient shape that allows effective retention of water or waste "up-stream" from the weir. Preferably, the weirs placed in the manholes are positioned centrally in the base of the manhole structure to prevent the trapping of debris or solids between the inflated weir and the upstream sewer line opening into the manhole. In the alternative, smaller inflatable weirs may be placed inside lines at other locations within the sewer network as desired or required.

As is apparent from the foregoing discussion, a first and necessary step in the process of installing such a pinch valve surcharge system is a comprehensive study of the sanitary sewage collection system or a review of data regarding the system that is to be built or retrofitted. The data or study allows determination of critical areas in the sewer network—the lowest points of entry such as basements, low lying homes, or service lines on other low lying buildings. Depending on the amount of surcharge required or desired at any particular location, the present invention may be practiced with an aggressive surcharge, a conservative surcharge, or a mixed surcharged wherein certain locations are aggressively surcharged and other areas are conservatively surcharged. An aggressive surcharge is designed to retain a maximum amount of water or dilute waste with sensors or monitors present to directly or indirectly monitor many critical points. A conservative surcharge simply allows for the retention of less of a surcharge and permits the use of fewer monitors or sensors (i.e. surcharge capacity is sacrificed in order to avoid approaching back-up levels of retained water or waste near potentially critical areas).

In practice, whether the system is aggressive, conservative, or mixed, monitors or sensors are preferably installed to detect the level of surcharged water or waste. These sensors may be linked to a centralized control system or a distributed control system. When a selected threshold level is reached, a signal is received by the computerized control system, or received directly by one or more valves or other retention means coupled with the monitor or sensor. In response to the signal, the appropriate flow retarding means may be opened to release at least a portion of the surcharged liquid. In this manner, flow through, and outflow from, the sewage collection system may be released in a controlled manner to retain a surcharge of matter, typically water and waste, in the system. The net effect of the surcharge is an increase in the weight of the collection system that helps to counteract the buoyant effects of hydrostatic pressure, and to minimize the differential and pressure across the sewer conduit wall.

If sensors are not used, or if desired for use in combination with sensors, dams, gates, weirs, or other control means may be set to allow flow-over at a desired elevation. This elevation is preferably determined with reference to a critical elevation (taking into account back-water surface elevation calculations if necessary or desired). In all embodiments of the present invention, it is preferred to periodically release at least a portion of the retained surcharge to minimize deposition of solids and undesired anaerobic activity. Although it is intended that the present invention protect critical areas, absolute protection is not essential to the present invention and the scope of the present invention is not limited to the practice of absolute protection of critical areas. Especially severe conditions (e.g. natural or artificial flooding, pipe breakage, or other unusual occurrences) may cause backup or flooding of critical areas. Such events, of course, are primarily unanticipated and/or they may be acts of nature. As such, it will be understood that determination of critical points and selected elevations are meant to provide protection under many or substantially all flow conditions and levels, but absolute protection is not required.

Therefore, the invention as described herein is well adapted to achieve the objectives as previously stated, including but not limited to, minimization of the impact of the buoyancy effect on the collection system and minimization of the infiltration of groundwater into the system due to the great differential and pressure across the conduit wall. The components utilized in the invention of the present system have been described generally herein. These components are known to those skilled in the relevant art and have been used in various other applications. However, these components have not been combined or used in the manner described herein. It is understood that the present invention, as illustrated and described herein and as set forth in the following claims, is a system for sewer surcharge creation and maintenance through controlled retention and release of water, waste, and other liquid and liquid born substances that are commonly or may be found in sewer systems. The selection of components to achieve this end is not intended to be limiting and the components described and recited herein are provided as examples of useful or preferred components.

What is claimed is:

1. An automated method for reducing the infiltration of material that is external to a waste treatment system that has a branched network of subterranean sewer pipes for carrying waste material to a waste water treatment facility, the sewer pipes including source pipes, intermediate pipes and main pipes, said source pipes having capacities less than said intermediate pipes and said intermediate pipes having capacities less than said main pipes, said source pipes being disposed to allow said waste material to flow into said intermediate or said main pipes, and said intermediate pipes being disposed to allow said waste material to flow into said main pipes and then into the waste treatment facility, said method comprising the steps of:

evaluating the sewer pipe network to identify a plurality of desired threshold flow levels of waste material at selected locations in the sewer network;

storing the desired threshold flow level data for the sewer network in a computer system;

determining the actual level of flow of waste material in the intermediate and main pipes of the sewer network so as to generate actual flow level data;

communicating the actual flow level data in the sewer network to the computer system;

comparing the actual flow level data to the desired threshold flow level data;

providing a plurality of flow retarding devices in the intermediate and main pipes of the sewer network; and retarding the flow in selected ones of the pipes in the sewer network to cause the actual flow levels in the selected ones of the pipes to approach the desired threshold flow level for the selected locations, thereby retaining a surcharge of material in the sewer network to reduce the flow of material into the waste treatment facility.

2. The method of claim 1 for reducing the infiltration of material into a subterranean sewer network in which the flow retarding device is a dam or weir.

3. The method of claim 1 for reducing the infiltration of material into a subterranean sewer network in which the flow retarding device is a gate valve.

4. The method of claim 1 for reducing the infiltration of material into a subterranean sewer network in which the flow retarding device may be manually controlled.

5. The method of claim 1 for reducing the infiltration of material into a subterranean sewer network in which the flow retarding device is a pinch valve.

6. The method of claim 1 for reducing the infiltration of material into a subterranean sewer network further comprising the step of:

identifying a critical point elevation and selecting said desired threshold flow level to protect said critical point elevation under substantially all flow conditions.

7. The method of claim 6 for reducing the infiltration of material into a subterranean sewer wherein the selection of said desired threshold flow level to protect said critical point elevation under substantially all flow conditions comprises the step of accounting for a backwater surface elevation difference between the flow retarding device and the critical point.

8. The method of claim 1 for reducing the infiltration of material into a subterranean sewer network further comprising the step of periodically releasing at least a portion of the retarded flow of material to prevent, lessen, or remedy the deposition of solids within the system and the anaerobic digestion of materials within the system.

9. The method of claim 1 wherein the sewer network includes a manhole and the flow retarding device is installed within said manhole.

10. A subterranean sewer system for receiving and conveying collected waste material in which system the infiltration of material external to the system is reduced, said system comprising:

a branched network of pipes comprising source pipes, intermediate pipes and main pipes, said source pipes having capacities less than said intermediate pipes and said intermediate pipes having capacities less than said main pipes, said source pipes being disposed to allow said collected material to flow into said intermediate or said main pipes, and said intermediate pipes being disposed to allow said collected material to flow into said main pipes;

a plurality of flow retarding devices positioned within said branched network of pipes wherein the flow retarding devices are dams;

a plurality of flow level sensors combined with said branched network of pipes to detect a pre-selected level of collected waste material at a plurality of pre-selected locations in said network; and a computer communicably combined with at least one of said flow retarding devices and at least one of said flow level sensors, said computer being adapted to generate a flow retarding device actuation signal if said at least one flow level sensor indicates detection of said pre-selected level of collected waste material.

* * * * *